US009339160B2

(12) United States Patent
Petersen et al.

(10) Patent No.: US 9,339,160 B2
(45) Date of Patent: May 17, 2016

(54) SILENCER SYSTEM FOR A VACUUM MOTOR IN A SUCTION CLEANER

(75) Inventors: Joakim Petersen, Copenhagen (DK); Peter Nøhr Larsen, Copenhagen (DK)

(73) Assignee: Nilfisk Advance A/S, Brondby (DK)

( * ) Notice: Subject to any disclaimer, the term of this patent is extended or adjusted under 35 U.S.C. 154(b) by 0 days.

(21) Appl. No.: 14/404,988

(22) PCT Filed: Jul. 4, 2012

(86) PCT No.: PCT/DK2012/000081

§ 371 (c)(1),
(2), (4) Date: Dec. 16, 2014

(87) PCT Pub. No.: WO2014/005586

PCT Pub. Date: Jan. 9, 2014

(65) Prior Publication Data

US 2015/0129353 A1 May 14, 2015

(51) Int. Cl.
*A47L 9/00* (2006.01)

(52) U.S. Cl.
CPC ..... *A47L 9/0081* (2013.01)

(58) Field of Classification Search
CPC ..... A47L 9/0081; F04D 29/665
USPC ..... 181/225, 231
See application file for complete search history.

(56) References Cited

U.S. PATENT DOCUMENTS

| | | | | |
|---|---|---|---|---|
| 4,655,694 | A * | 4/1987 | Berfield | A47L 9/22 15/326 |
| 4,665,581 | A * | 5/1987 | Oberdorfer | A47L 9/0081 15/326 |
| 5,289,612 | A | 3/1994 | Glenn, III | |
| 7,425,225 | B2 | 9/2008 | Genn et al. | |
| 2006/0254022 | A1 * | 11/2006 | Oh | A47L 9/0081 15/412 |

FOREIGN PATENT DOCUMENTS

| | | | |
|---|---|---|---|
| CN | 101057763 | A | 10/2007 |
| WO | WO01/74025 | A1 | 10/2001 |

OTHER PUBLICATIONS

International Search Report for PCT/DK2012/000081, dated Oct. 29, 2012, 2 pages.

* cited by examiner

*Primary Examiner* — Jeremy Luks
(74) *Attorney, Agent, or Firm* — Ware, Fressola, Maguire & Barber LLP

(57) ABSTRACT

The present invention relates to a silencer system for a vacuum motor in a suction cleaner, which may be constructed using only one or two parts to form a housing for the vacuum motor including the silencer system. The system may have a main fan silencer system for the main fan and a second motor cooling silencer system for the motor cooling fan. The main fan is encapsulated in a housing surrounded by a substantially circular first wall part in such a way that a first cavity is formed between the housing and the first wall part. The system further includes two ducts, each duct connected at one end with a serpentine shaped exhaust air duct and at the other end with a second cavity connected with the first cavity by an opening in the first wall part.

6 Claims, 10 Drawing Sheets

SILENCER SYSTEM FOR A VACUUM MOTOR IN A SUCTION CLEANER

CROSS REFERENCE TO RELATED APPLICATIONS

This application is a National Stage of PCT International patent application no. PCT/DK2012/000081, filed 4 Jul. 2012, the contents of which are hereby incorporated by reference.

TECHNICAL FIELD

The present invention relates to a silencer system for a vacuum motor in a suction cleaner.

BACKGROUND

A conventional suction cleaner is a cleaner where part of the cleaning process is sucking up of air, normally mixed with dust, debris, or a dirty water solution, where the dust, the debris or the dirt is filtered off in the cleaner and conveyed to a bag or container before the air is exhausted.

An example of such a suction cleaner is a normal household vacuum cleaner. Other suction cleaners may be specially designed to pick up dirty liquids, examples are e.g. scrubber dryers, carpet extractors, and wet & dry vacuum cleaners. A scrubber dryer is a cleaning appliance which scrubs a surface and recovers the solution, leaving the surface dry and clean. The cleaning is done by applying a solution (water and detergent) to the surface, such as a floor, with a rotating or vibrating brush or a pad. After having worked on the floor for some time, the dirty solution is picked up by an airflow inside a nozzle (a squeegee). Subsequently the dirty solution is separated from the airflow inside the recovery tank of the scrubber dryer.

The airflow is generated by a vacuum motor, which is a unit consisting of a radial fan and an electric motor. Besides the fan for generating the vacuum, the motor may further comprise a separate fan to cool the motor. In order to create sufficient airflow, the unit runs at a high revolution speed, typically 18,000 RPM, for motors running on low voltage from a battery and, typically 30,000 RPM for motors running on voltage from the mains (110 or 230 Volts). This high revolution speed leads to two different sources of noise. A first source is due to the imbalance of the unit, which may never be balanced 100%. The imbalance induces a mechanical vibration with a frequency of typically 300 Hz for low voltage driven appliances and even higher (500 Hz) for mains driven. The mechanical vibration of the vacuum motor—if not controlled—sets the whole body of the appliance into vibration, which may lead to the radiation of a powerful noise from the body with a frequency of typically 300 Hz-500 Hz. Another source of noise is aerodynamic in nature and is due to the high air velocities inside the main fan and the cooling fan of the vacuum motor. The aerodynamic source may again be divided into two different types of noise; a broadband noise over a wide frequency range (typically 500 Hz to 10,000 Hz) arising from the turbulent nature of the flow, and a narrow band noise (with a number of discrete frequencies only typically in the range 2500 Hz to 6000 Hz). The narrow band noise is due to the fact that the fans have a finite number of fan blades.

Normally, the noise from the exhaust of air from the main fan is reduced by an absorbing material such as rubber foam. In order for the foam to be effective it must be placed close to the exhaust air, and in order to obtain this the wall of the exhaust duct is covered by sound absorbing foam. However, the use of foam may cause two problems: the first problem is that the foam may easily block the air path of the exhaust air and, consequently, reduce the airflow and the recovery performance of the appliance. The second problem is the ability of the foam to suck up moisture, which may lead to growth of mould and bacteria, thus, making the appliance unsanitary. Foam is also an extra part which adds costs to the appliance. The noise from the fan cooling the motor may be controlled in a similar way; however, in many suction cleaners this noise is not controlled at all.

The noise from imbalance is normally controlled by a flexible mounting such as a rubber gasket between the vacuum motor and the scrubber dryer body; however, since the vacuum motor is often bolted to the body, the effect of the flexible mounting is often rather limited.

In recent years, the technique of a reactive silencer has been introduced on cleaning appliances with vacuum motors. The principle of a reactive silencer is to change the acoustic impedance of the exhaust duct to minimize noise propagation rather than absorbing the noise energy and to transform the noise energy into heat. This noise reflection with a reactive silencer occurs where the exhaust duct changes cross-sectional area or direction. One well known principle is to release the exhaust air and noise in a relatively large cavity and then connect the exhaust duct to this cavity. The noise related to the release of exhaust air from the fan may then be controlled by the volume of the cavity, and the length and width of the exhaust duct. The best result is obtained for a large cavity, and a narrow and long exhaust duct. This principle is explained in the European patent EP 1 266 501 B1, which also discloses how to obtain a long and narrow exhaust duct, e.g. by the use of a serpentine shaped duct. A similar principle of noise reduction in a vacuum cleaner is known from the Chinese patent CN100556352 C.

However, the known techniques mainly aim at reducing the noise related to the fan for generating the main airflow used for pick-up.

SUMMARY OF THE INVENTION

An object of the present invention is to improve the noise reduction in a suction cleaner.

The present invention provides a solution to reducing the overall noise from a suction cleaner device, wherein both the noise related to the main fan generating vacuum and the noise from the fan cooling the motor may be reduced.

Moreover, the present invention provides an efficient and relatively cost effective system of reducing the noise from a suction cleaner device, which may be used on devices operating with air and with air and liquid.

The present invention also provides a noise reduction system that may be incorporated in a compact unit, which may comprise only two different parts, and may thus be cost-effectively produced. For a dry suction cleaner, the present invention may be constructed to comprise only one single part.

Consequently, the present invention provides a silencer system for a vacuum motor in a suction cleaner, said vacuum motor comprising a main fan encapsulated in a housing surrounded by a substantially circular first wall part in such a way that a first cavity is formed between the housing and the first wall part. The system further comprises two ducts, each connected at one end with a serpentine shaped exhaust air duct and at their other end with a second cavity, said second cavity being connected with the first cavity by an opening in the first wall part.

In this silencer system, a better noise reduction may be achieved when the system comprises a further or second cavity between the first cavity around the housing for the main fan and the serpentine shaped exhaust duct. The serpentine shaped duct serves to achieve a long duct in a relatively compact construction. The cavities are to be construed as chambers or compartments in the structure delimited by wall parts or other parts of the suction cleaner structure, such as e.g. the outer periphery of the main fan housing.

In combination with the first cavity and the second cavity, the two ducts serve to reduce the noise efficiently before the final noise reduction in the serpentine shaped exhaust air duct. When the noise exits the second cavity, the noise will enter a first or a second one of the two ducts, and this "splitting up" of the noise ensures an efficient noise reduction.

The two ducts may have their exit at the entrance of the serpentine shaped exhaust duct, and the "split up" noise may be joined and exposed to a final reduction in the serpentine shaped exhaust duct. However, the system may also comprise two serpentine shaped ducts, wherein each of the two ducts is connected with a serpentine shaped exhaust duct.

In one embodiment, the two ducts extend between the second cavity around the first wall part to the entrance of the serpentine shaped exhaust duct. In this embodiment, it is possible to achieve a very compact design, and, moreover, the first wall part may form at least a portion of the two ducts. Thus, one side of the first wall part may enclose the first cavity, and the other side of the first wall part may form a wall for the two ducts. Moreover, a second wall part may form at least a portion of the two ducts When the first wall part forms part of the two ducts, an embodiment in which the two ducts are curved may be achieved. This is due to the fact that the first wall part follows a circular curve to encapsulate the housing of the main fan, which has a circular cross section. However, the curved shape of the two ducts may further serve to reduce the noise, as the curved shape may increase the length of the ducts.

Moreover, to maximize the noise reduction it is preferred that the two ducts have substantially the same length.

The silencer system according to the present invention also provides an embodiment in which the vacuum motor further comprises a cooling air fan, said silencer system comprising an inlet channel and an outlet channel for cooling air, wherein the inlet channel is connected with an inlet air chamber, and the outlet channel is connected with an outlet air chamber.

The present invention thus provides a system that efficiently reduces the noise from a suction cleaner by reducing the noise caused by the action of the main fan and furthermore the noise caused by the motor cooling fan, when such a motor cooling fan is present, and by this "double function" noise reduction the overall noise from the operating suction cleaner is significantly reduced.

In some vacuum motors, the main fan, besides forming the vacuum for suction, also cools the motor. However, in suction cleaners intended for use with liquids this is not possible, as such a construction will have potential risk of short circuiting.

In this context, the main fan is responsible for creating the vacuum and thereby the suction effect. The main fan may also serve to cool the motor in some cases. However, in suction cleaners that are used with liquids, a separate fan for cooling the motor is provided. This separate fan is denoted the cooling air fan. Thus, as indicated, the two types of fans, i.e. the main fan and the cooling air fan, normally serve two different purposes.

To obtain good properties of the silencer system according to the invention, the inlet air chamber for cooling air is placed adjacent to the cooling air intake on the vacuum motor. In this manner, the noise may be reduced by having a rather large chamber for cooling air next to the air intake on the vacuum motor.

To obtain noise reduction at the outlet openings for the cooling air, an outlet air chamber is placed adjacent to the cooling air outlet of the vacuum motor.

For the purpose of reducing the space requirements in the silencer system, an embodiment wherein the inlet channel is partly located in the inlet air chamber is provided. Moreover, an embodiment wherein the outlet channel, in a corresponding manner, is partly located in the outlet air chamber is also provided.

The silencer system according to the invention also comprises an embodiment in which the inlet channel and the outlet channel are substantially parallel. This embodiment also serves to ensure that a very compact design may be achieved.

Moreover, to achieve an optimum design of the silencer system in respect of the mounting of the vacuum motor, it is preferred that the inlet channel and the outlet channel are located with the inlet opening and the outlet opening facing downwards. By having this design, the cooling air for the motor cooling fan may be admitted and exhausted below the vacuum motor, whereby a very compact design of the housing for the vacuum motor may be provided.

In another embodiment, the inlet opening of the inlet channel and the outlet opening of the outlet channel may be placed offset. In this embodiment, the inlet opening of the inlet channel may, furthermore, be placed in a lower position than the outlet opening of the outlet channel. Thus, the embodiment may ensure that the hot cooling air exhausted from the outlet opening will rise and reduce the risk of the hot cooling air being conveyed to the inlet channel.

The silencer system according to the present invention also provides embodiments wherein the inlet air chamber and/or the outlet air chamber is divided into two or more compartments. These embodiments may serve to save space and allow for a more compact design of the silencer system.

In an embodiment of the silencer system according to the invention, the main fan silencer system and the motor cooling air silencer system are contained in the same housing. By using this embodiment a very compact silencer system may be achieved. The housing may further comprise an insert part that may contain the motor including the main fan and the cavity around the housing of the main fan, and moreover, the motor cooling fan and at least a portion of the air intake chamber and/or the air outlet chamber. An optional connection between the main fan silencer system and the motor cooling air silencer system may be closed by a gasket to avoid any undesired interference between the two systems.

According to a further embodiment of the silencer system, the ducts and the cavities and/or air chambers of the main fan silencer system and the motor cooling air silencer system are formed by the walls of the housing. The housing and optional insert part may be made from a thermoplastic material, such as ABS. However, it is also possible to manufacture the housing in a metallic material, such as stainless steel or aluminium.

It has been realized that to achieve a high degree of noise control, it is necessary that the value of the ratio VL/A is large and preferably larger than 0.16 $m^2$. In the value ratio, L is the length in meters and A is the cross-sectional area in $m^2$ of the duct, and V is the volume of the cavity or chamber in $m^3$. Consequently, to optimize the noise reduction the volume of the cavity/chamber and the length of the duct should be maximized and the cross-section should be minimized. However, in order to avoid a too high flow loss in the duct a minimum cross-sectional area is required. This required minimum cross-sectional area depends on the performance of the fan, and the ratio of the length of the duct to the cross-sectional area of the duct can be considered to be a trade-off between noise reduction and flow properties.

BRIEF DESCRIPTION OF THE DRAWINGS

In the following, the present invention will be explained in further detail with reference to preferred embodiments and the figures, in which.

DETAILED DESCRIPTION OF THE INVENTION

Figure 1:
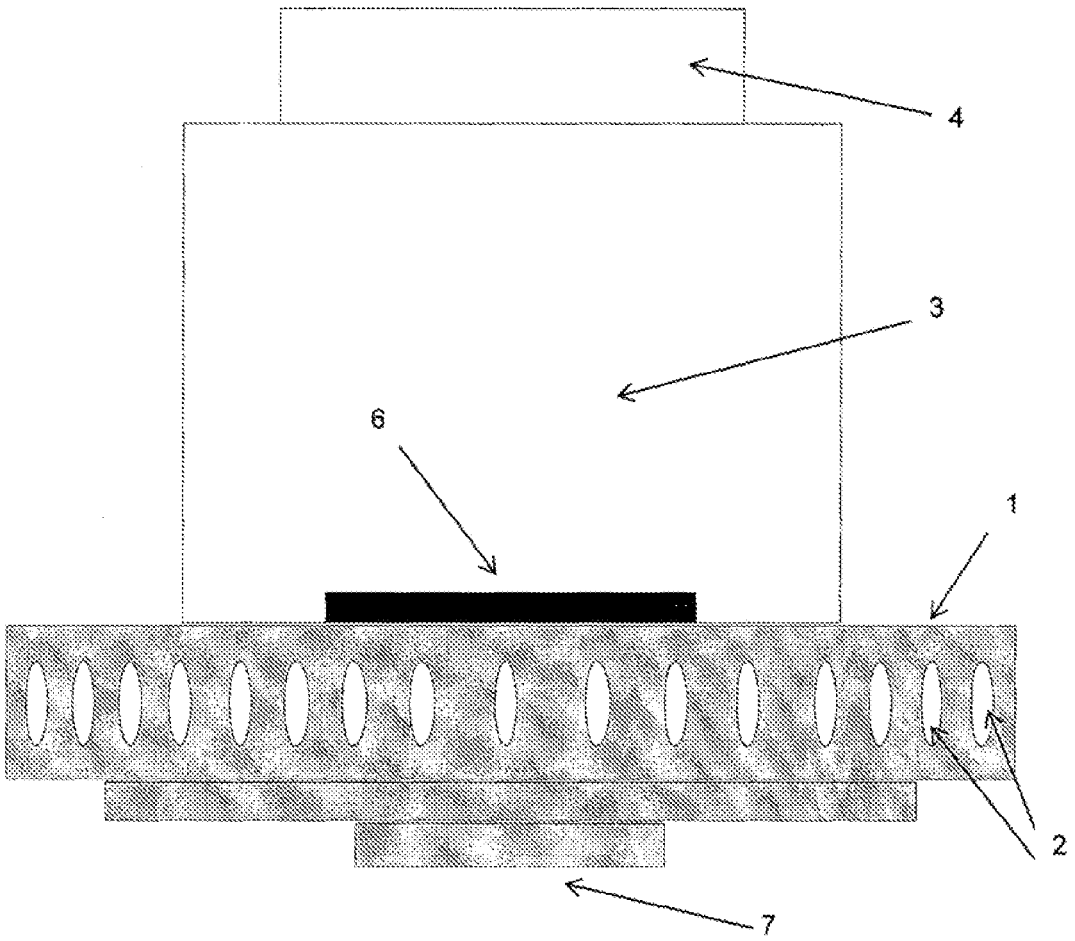
FIG. 1 shows a schematic lay-out of a by-pass cooled vacuum motor.

FIG. 1 shows a lay-out of a by-pass cooled vacuum motor, which is well-known and suitable for use in a floor cleaning appliance, such as a suction cleaner.

The motor comprises a radial main fan covered by a housing 1. The housing comprises openings 2 for the exhaust air. The noise from the main fan is also released through these openings 2. The air intake for the main fan is shown at 7.

The motor 3 further comprises a motor cooling fan encapsulated in a housing 4 and an air intake 5 and an air outlet 6 for the motor cooling fan.

Figure 2:
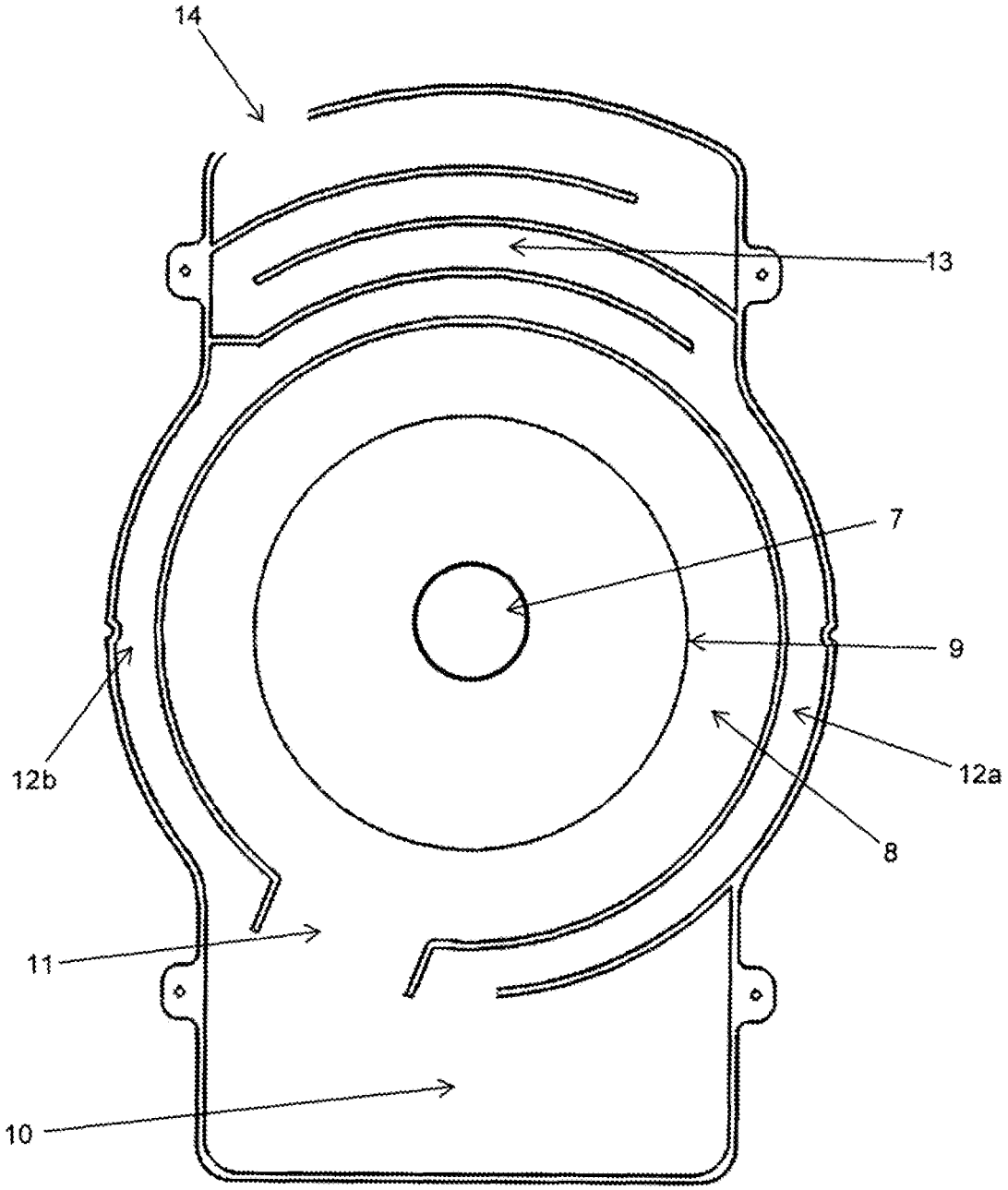
FIG. 2 shows a top view of the first silencer system according to the invention.

FIG. 2 shows a top view of the first silencer system for the main fan encapsulated in housing 9 surrounded by a first cavity 8, which is connected with a second cavity 10 via an opening 11.

The second cavity 10 is connected with two curved ducts 12*a* and 12*b* located around a wall part encircling the cavity 8. The two curved ducts 12*a* and 12*b* are further connected with a serpentine shaped duct 13 which ends at the exhaust opening 14.

The reactive silencer according to the preset invention has been found to be able to control noise through four different paths of propagation by use of the special vacuum motor housing consisting of two parts only. The two parts A and B are seen clearly in FIG. 3. The vacuum motor with gaskets is seen as C.

Figure 3:
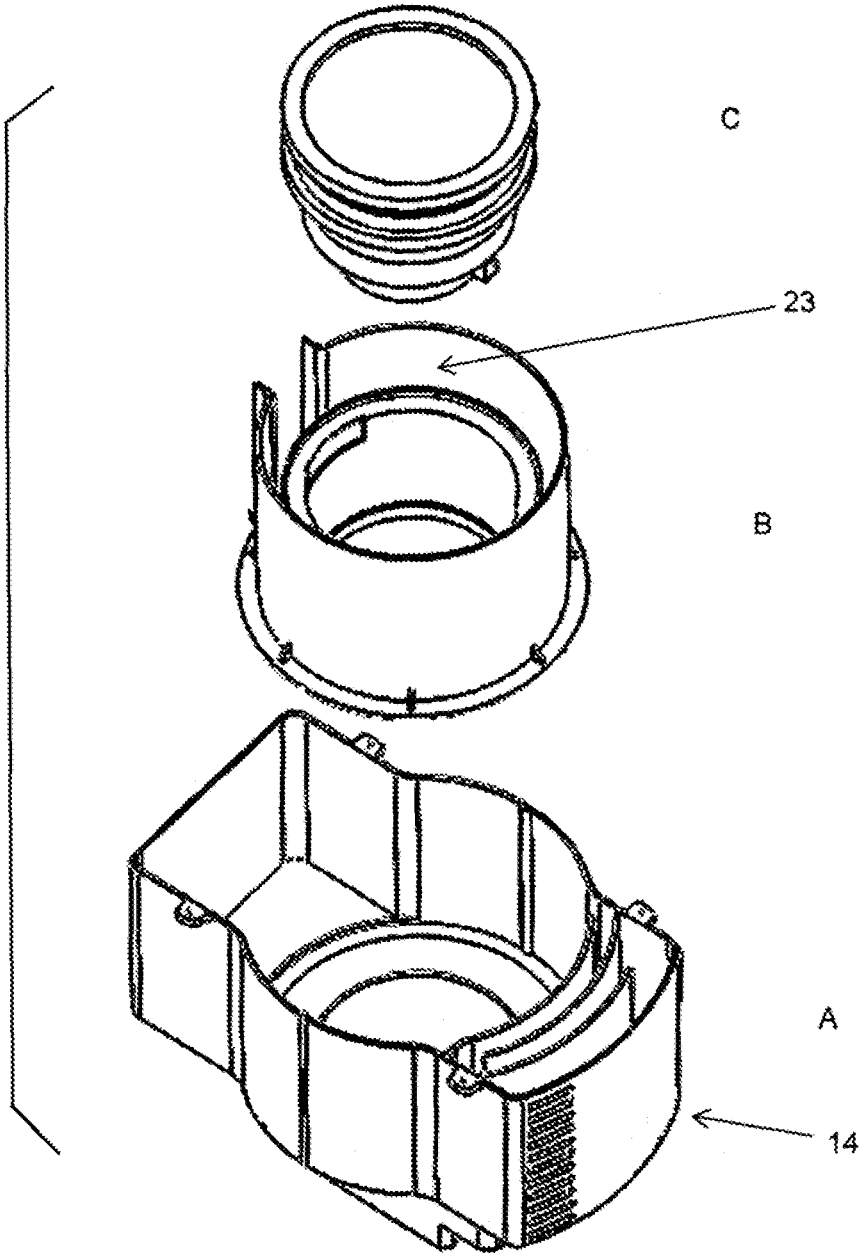
FIG. 3 shows an exploded view of a silencer system according to the invention.

Two different principles of noise control are used. The noise control principle of the silencer for the main fan airflow as shown in FIG. 2 is the first cavity 8 around the intake fan or sound source 9, which communicates with the second cavity 10 via the opening 11. This second cavity again passes the air and noise out through two curved ducts 12*a* and 12*b* formed between two cylindrical shells of the housing, which are again followed by the longer serpentine shaped duct 13. The second cavity 10 and the serpentine shaped duct 13 are placed on opposite sides of the first cavity 8 in order to create a compact design. The two curved ducts 12*a* and 12*b* partly circumvent the first cavity 8 and are formed between the inner housing or insert piece B and the outer housing or cover piece A, as indicated in FIG. 3. The opening 11 is placed in such a way that the two ducts 12*a* and 12*b* have substantially the same length.

The basic noise control principles of the silencer system for the motor cooling air fan are the same. Here, it has been found that there are two paths of noise propagation, one through the intake duct for cold air and one through the exhaust duct for hot air. For the cold air duct, the noise source is considered to be located at the fan itself or the intake opening 5 for the cold air on the vacuum motor 3, as seen in FIG. 1. For the hot air duct, the noise source is considered to be located at the exhaust opening 6 of the vacuum motor 3. According to the basic principle for the two silencer systems, the sound source is encapsulated in a cavity, which is followed by a straight or curved and relatively long exhaust duct.

Figure 4:
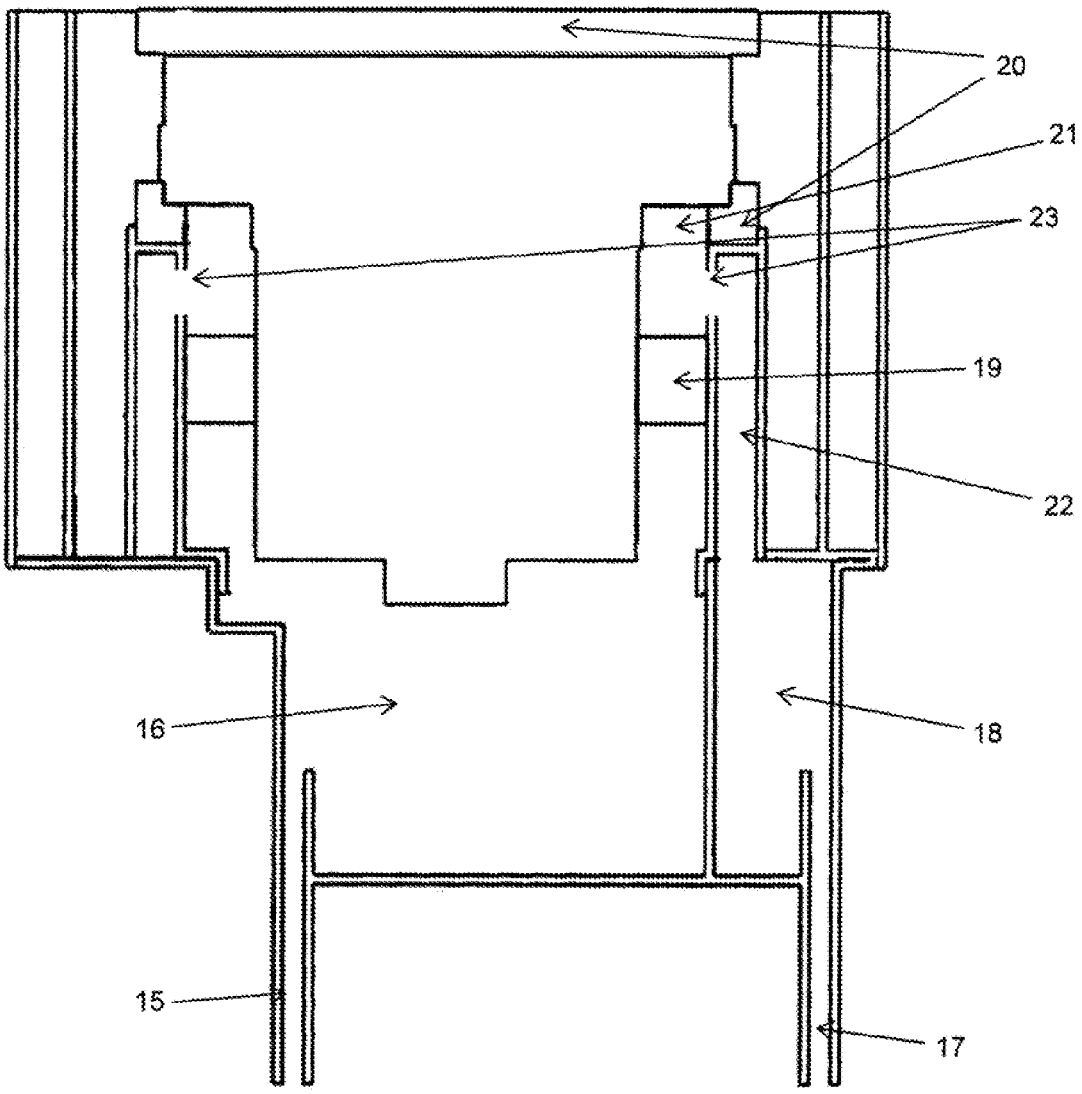
FIG. 4 shows the principles of the motor cooling fan cooling system.

As shown schematically in FIG. 4, the noise through the duct for cold intake air is controlled by having the intake opening 5 of the vacuum motor C placed in a cavity 16, and in order for noise to escape this cavity it has to pass a relatively long and narrow channel 15 for the intake of cooling air. The air inlet channel 15 is partly placed inside the cavity 16. This design is chosen for the purpose of reducing the total height of the construction and thereby the total volume of the whole silencer arrangement.

With reference to FIGS. 1 and 4, noise through the duct for hot exhaust air is controlled by having the outlet openings 6 of the vacuum motor C placed in a first exhaust compartment 21, which is formed between the vacuum motor, the inner housing B, and the sealing ring 19. The sealing ring 19 is only needed for some vacuum motors, which have an irregularly shaped inlet opening to the cooling fan. For the vacuum motors with a regular inlet opening 5 to the cooling fan as shown in FIG. 1, the sealing ring 19 is not needed, instead the compartment 16 should be shaped to be in close contact with the inlet opening 5. The first exhaust compartment 21 communicates with a second exhaust compartment 22 though two openings 23. The second exhaust compartment 22 is formed in the inner housing B. In order for noise to escape this cavity it has to pass a relatively long and narrow outlet channel 17. After the second exhaust compartment 22, air and noise are conveyed to a third exhaust air compartment 18, which again communicates with the outside via the channel 17 for the exhaust of hot cooling air. The first 21, the second 22 and the third 18 exhaust compartments together form an outlet air chamber.

Figure 5:
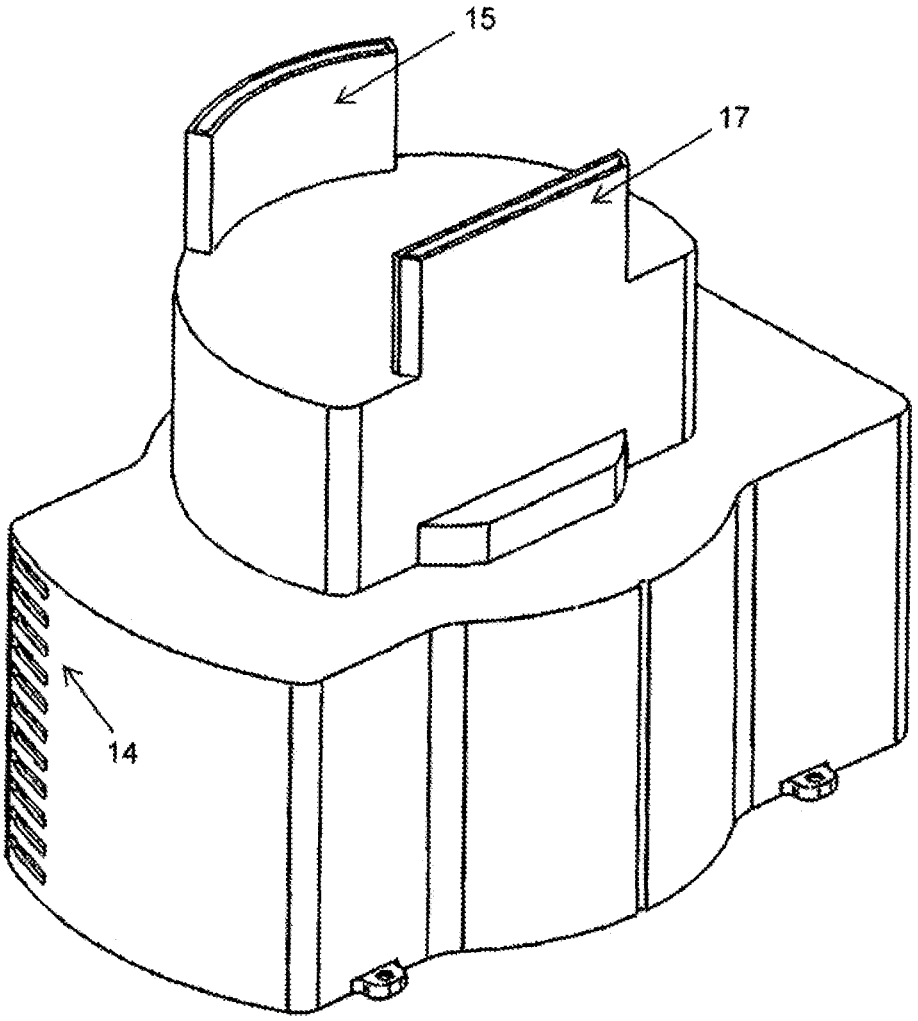
FIG. 5 shows a unit comprising the silencer system according to the invention.
Figure 7:
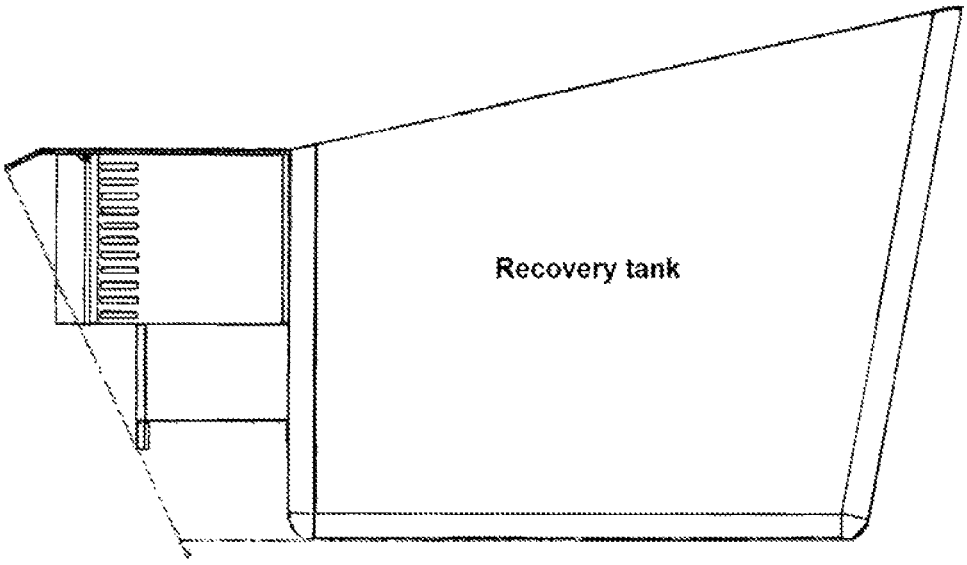
FIG. 7 shows a unit mounted on a recovery tank.

FIG. 5 shows an embodiment of a silencer unit according to the invention. This silencer module may be in communication with a recovery tank, as shown in FIG. 7, where one side of the silencer unit faces the outside of the recovery tank in such a way that the inlet opening of the vacuum motor corresponds to an opening in the recovery tank in order to produce an airflow through the recovery tank and thus through the whole debris or solution recovery system.

In FIG. 5, the channel 15 for the intake of cold cooling air is seen together with the channel 17 for the exhaust of hot cooling air. As may be seen, the inlet channel 15 is substantially parallel with the outlet channel 17. The opening for the exhaust of air from the main fan is also seen in the form or orifices 14 in the wall of the silencer unit. In order to minimize the recirculation of hot exhaust air from 17 into the intake 15 the opening to 15 should be positioned lower than the opening to 17. This is because the hot air from the outlet channel 17 rises in the ambient air. For some appliances such as a scrubber dryer, the silencer module is placed with the outlet channel 17 and the intake channel 15 below the module. In that case, the intake channel 15 should be longer than the outlet channel 17 to position the intake of air 15 below the exhaust of air 17. Alternatively, a moulded wall could be placed between 15 and 17. A typical realization of the wall is illustrated in FIGS. 9 and 10.

Figure 9:
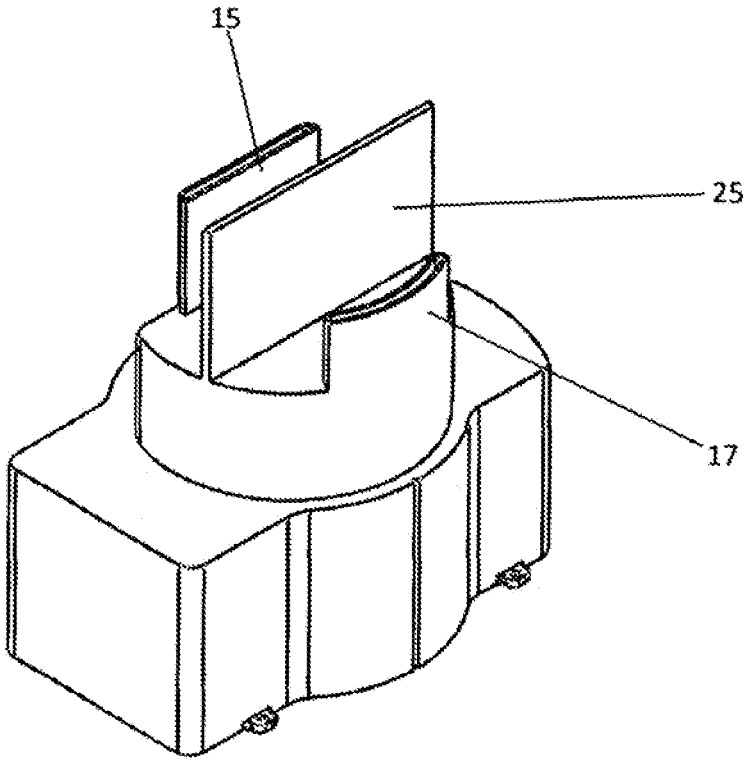
FIG. 9 shows an alternative embodiment of the silencer unit.

In FIG. 9 it is shown how a wall 25 is placed between the inlet channel 15 and the outlet channel. The wall 25 efficiently ensures that a flow of hot exhaust air from the outlet channel 17 does not reach the inlet channel 15 and does not mix up with the cold cooling air.

Figure 10:
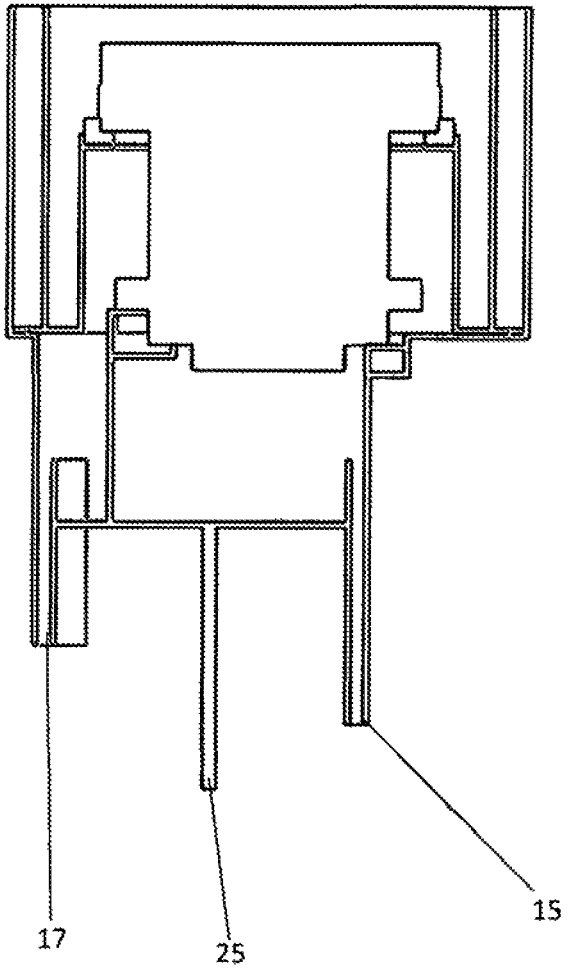
FIG. 10 shows a cut through the alternative embodiment of FIG. 9.

FIG. 10 is a cut through the structure, showing the wall 25 placed between the intake channel 15 and the outlet channel 17. As may be seen, the intake for cooling air 15 is positioned lower than the exhaust 17 for hot air. As the hot air exhausted from the outlet channel 17 is warmer than the ambient air, this hot air will rise and not reach the intake channel 15 for cooling air. FIG. 10 also shows an alternative embodiment of the invention, which is suitable for a vacuum motor with a regular intake opening to the cooling fan. In this case the inlet opening to the cooling fan is placed directly in the expansion chamber.

Figure 6:
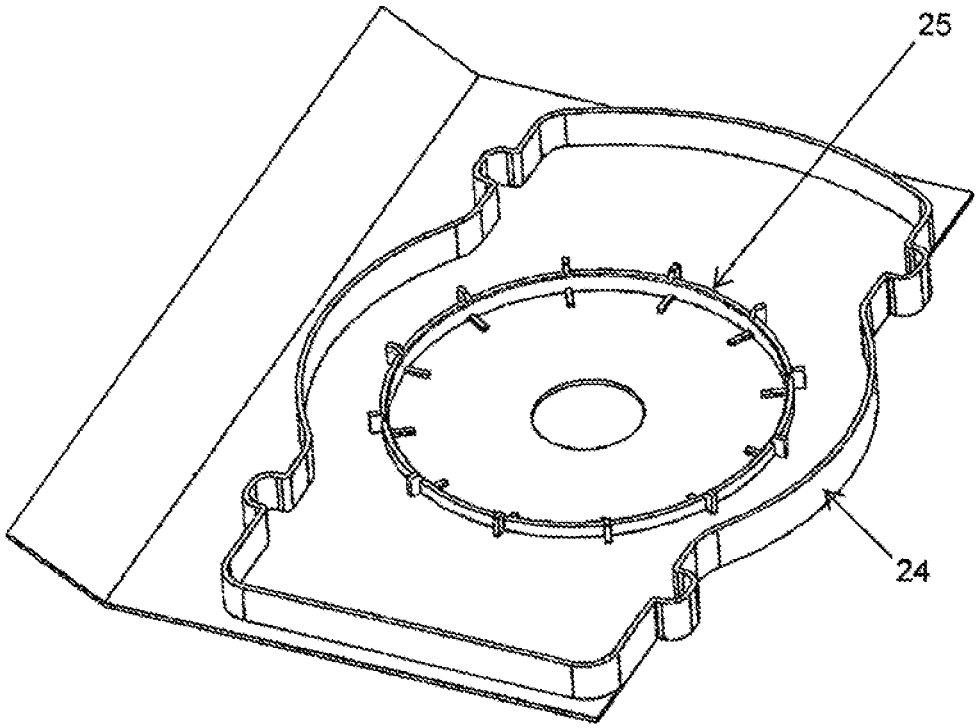
FIG. 6 shows a receiving structure for the unit.

FIG. 6 shows a receiving structure which may be attached to the outside of the recovery tank. The receiving structure comprises a wall 24 to provide sealing around the perimeter of the silencer unit. In order to avoid noise leakage around the perimeter of the silencer module, a sealing between the silencer module and the receiving structure must be made. This sealing may be a simple labyrinth sealing formed between a wall 24 and the outside of the silencer module or a gasket in a soft material. An airtight sealing should also be provided between the inlet opening of the vacuum motor and the corresponding opening in the recovery tank. Moreover, the receiving structure comprises a wall 25 to support a gasket around the inlet opening for the vacuum motor.

FIG. 7 shows an example of the mounting of the silencer unit. The unit is mounted on a flange, which is part of the recovery tank. Once the lid is put on the recovery tank, the inlet opening to the vacuum motor is in airtight communication with the interior of the recovery tank.

Figure 8:
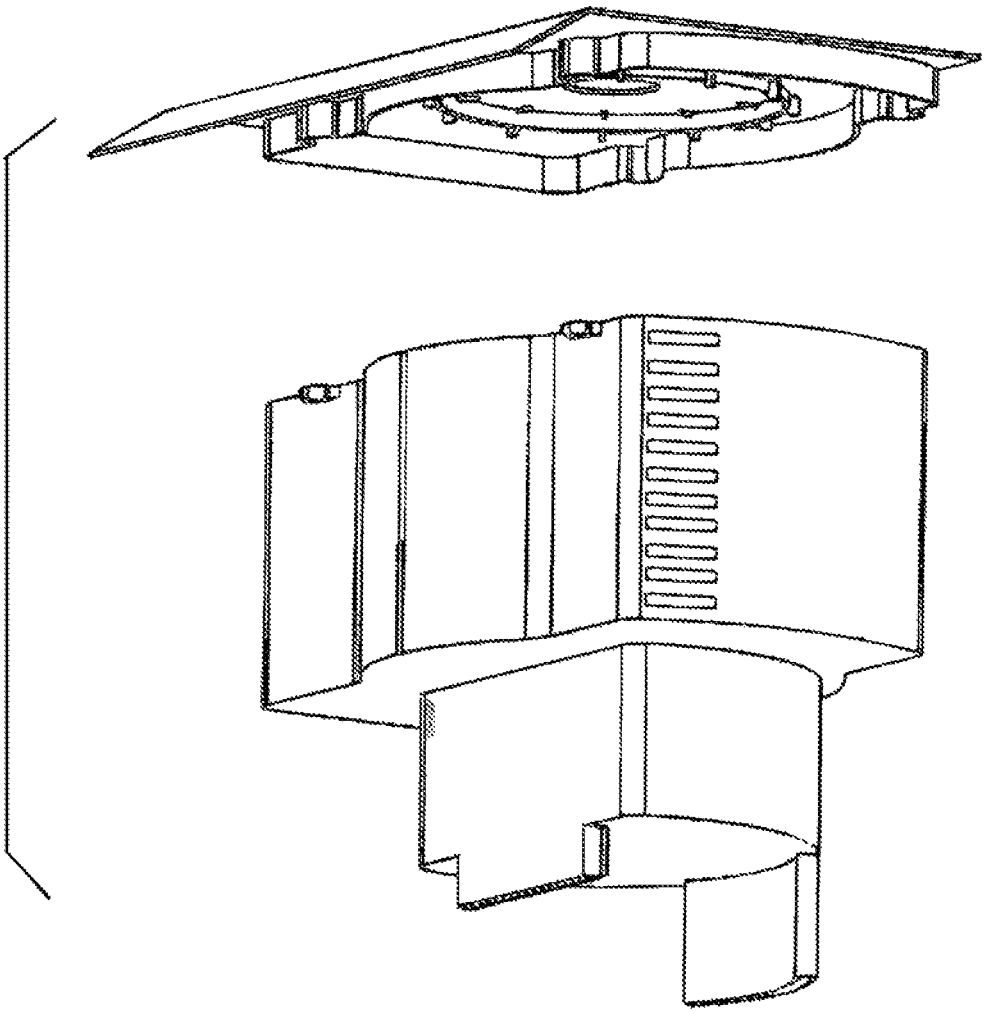
FIG. 8 shows mounting of the silencer unit on the receiving structure.

Finally, FIG. 8 shows how to mount the silencer unit on the receiving structure of the recovery tank.

Consequently, the present invention provides a silencer system for a vacuum motor in a suction cleaner which may be constructed using only one or two parts to form a housing for the vacuum motor. The silencer system may comprise a first silencer system for the main fan, which may be the sole system. However, the system may also include a second motor cooling silencer system for a motor cooling fan in case the vacuum motor comprises a motor cooling fan in addition to the main fan. If the system only requires the silencer system for the main fan, the system may be constructed from one part only.

The invention claimed is:

1. A silencer system for a vacuum motor in a suction cleaner, comprising:

a vacuum motor having a main fan encapsulated in a housing surrounded by a substantially circular first wall part in such a way that a first cavity is formed between the housing and the first wall part, and, two ducts, each duct connected at one end with a serpentine shaped exhaust air duct and at another end with a second cavity, said second cavity being connected with the first cavity by an opening in the first wall part, wherein the vacuum motor further comprises a cooling air fan, said silencer system further comprising a cooling air inlet channel and a cooling air outlet channel, an inlet air chamber being connected with said cooling air inlet channel, and an outlet air chamber being connected with said cooling air outlet channel, and wherein the outlet air chamber is adjacent to a cooling air outlet of the vacuum motor.

2. The silencer system according to claim 1, wherein the inlet air chamber is adjacent to a cooling air intake on the vacuum motor.

3. The silencer system according to claim 1, wherein an inlet opening of the cooling air inlet channel is placed in a lower position than an outlet opening of the cooling air outlet channel.

4. A silencer system for a vacuum motor in a suction cleaner, comprising:

a vacuum motor having a main fan encapsulated in a housing surrounded by a substantially circular first wall part in such a way that a first cavity is formed between the housing and the first wall part, and, two ducts, each duct connected at one end with a serpentine shaped exhaust air duct and at another end with a second cavity, said second cavity being connected with the first cavity by an opening in the first wall part, wherein the vacuum motor further comprises a cooling air fan, said silencer system further comprising a cooling air inlet channel and a cooling air outlet channel, an inlet air chamber being connected with said cooling air inlet channel, and an outlet air chamber being connected with said cooling air outlet channel, and wherein the cooling air inlet channel is partly located in the inlet air chamber.

5. A silencer system for a vacuum motor in a suction cleaner, comprising:

a vacuum motor having a main fan encapsulated in a housing surrounded by a substantially circular first wall part in such a way that a first cavity is formed between the housing and the first wall part, and, two ducts, each duct connected at one end with a serpentine shaped exhaust air duct and at another end with a second cavity, said second cavity being connected with the first cavity by an opening in the first wall part, wherein the vacuum motor further comprises a cooling air fan, said silencer system further comprising a cooling air inlet channel and a cooling air outlet channel, an inlet air chamber being connected with said cooling air inlet channel, and an outlet air chamber being connected with said cooling air outlet channel, and wherein the cooling air outlet channel is partly located in the outlet air chamber.

6. A silencer system for a vacuum motor in a suction cleaner, comprising:

a vacuum motor having a main fan encapsulated in a housing surrounded by a substantially circular first wall part in such a way that a first cavity is formed between the housing and the first wall part, and, two ducts, each duct connected at one end with a serpentine shaped exhaust air duct and at another end with a second cavity, said second cavity being connected with the first cavity by an opening in the first wall part, wherein the vacuum motor further comprises a cooling air fan, said silencer system further comprising a cooling air inlet channel and a cooling air outlet channel, an inlet air chamber being connected with said cooling air inlet channel, and an outlet air chamber being connected with said cooling air outlet channel, and wherein the cooling air inlet channel and the cooling air outlet channel are substantially parallel.

* * * * *